US006860250B1

(12) United States Patent
Plenzler et al.

(10) Patent No.: US 6,860,250 B1
(45) Date of Patent: Mar. 1, 2005

(54) ENGINE LUBRICATION SYSTEM AND PRESSURE REDUCING VALVE FOR LIMITING OVERHEAD OIL FLOW

(75) Inventors: Jeremy M. Plenzler, Royal Oak, MI (US); Liyun Zheng, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/666,864

(22) Filed: Sep. 18, 2003

(51) Int. Cl.[7] ..... F01M 1/00
(52) U.S. Cl. ..... 123/196 R
(58) Field of Search ..... 123/196 R, 196 M, 123/90.34, 90.33, 90.16

(56) References Cited

U.S. PATENT DOCUMENTS 4,512,298 A * 4/1985 Hayashi ..... 123/196 R
5,220,891 A * 6/1993 Nakamura et al. ..... 123/90.16
5,704,315 A * 1/1998 Tsuchida et al. ..... 123/90.16
5,915,348 A * 6/1999 Scheidt et al. ..... 123/90.17
6,230,680 B1 * 5/2001 Pirone ..... 123/196 R

* cited by examiner

*Primary Examiner*—Tony M. Argenbright
*Assistant Examiner*—Hyder Ali
(74) *Attorney, Agent, or Firm*—Karl F. Barr, Jr.

(57) ABSTRACT

A lubrication system for an internal combustion engine having a pressure reducing valve to optimize oil flow through an engine to increase engine efficiency. The lubrication system includes an engine driven oil pump connected to supply pressurized oil through a main oil feed to a main bearing gallery, a cam gallery and a hydraulically actuated device such as a cam phaser or switching valve lifters. A pressure reducing valve connected between the main bearing feed restricts oil flow to the cam gallery to raise oil pressure supplied to the hydraulically actuated device. The increased oil pressure to the hydraulically actuated device allows the engine to use a smaller oil pump and thereby increase engine efficiency while providing for actuation of the cam phaser or the switching lifters over the full engine speed range.

11 Claims, 2 Drawing Sheets

ENGINE LUBRICATION SYSTEM AND PRESSURE REDUCING VALVE FOR LIMITING OVERHEAD OIL FLOW

TECHNICAL FIELD

This invention relates to engine oil systems and, more particularly, to a system including a pressure reducing valve to optimize oil flow and pressure for various lubrication and actuation functions.

BACKGROUND OF THE INVENTION

Internal combustion engines may use lubricating oil for many purposes including for example, lubricating moving parts, actuating cam phasers, and controlling switching valve lifters for valve stepping and cylinder deactivation. Cam phasers and cylinder deactivation devices generally require a higher oil pressure for actuation during engine operation than the moving parts of the engine require for proper lubrication. Switching lifters generally require high oil pressure for high lift operation and a lower oil pressure for low lift operation.

Since engines having cam phasers or cylinder deactivation devices generally require higher than normal oil pressure for their operation, while other components which do not require high pressure lubrication, such as a valve train components, can be over lubricated. Since valve trains commonly require a relatively low oil pressure to provide adequate lubrication to prevent engine wear, a method of reducing oil pressure to an engine's valve train is desired to reduce overall oil flow and increase engine efficiency.

SUMMARY OF THE INVENTION

Co-pending applications pertaining to related subject matter were filed concurrently with this application on Sep. 18, 2003 as U.S. application Ser. No. 10/666,745 (GP-302777), U.S. application Ser. No. 10/666,233 (GP-303044), and U.S. application Ser. No. 10/667,748 (GP-303046).

The present invention provides an oil system for an internal combustion engine having a pressure reducing valve to optimize oil pressures in the engine while increasing engine efficiency by minimizing parasitic losses created from over lubrication.

In an exemplary embodiment, the oil system includes an oil pump having an inlet and an outlet. An oil pickup connected with the inlet extends into an engine oil sump to draw oil into the oil system. The outlet of the oil pump connects to a main oil feed which supplies oil to a main bearing gallery and a hydraulically actuated device such as a cam phaser or switching lifters. Oil sent to the cam phaser is used to actuate the cam phaser, while oil directed to the main bearing gallery is used primarily for lubrication purposes. When switching lifters are present, some of the oil directed to the cam phaser is diverted to a control, which supplies oil pressure to the switching lifters to allow valve stepping or cylinder deactivation. In addition, some of the oil pumped into the main bearing gallery is sent through a cam gallery feed to a cam gallery in an upper part of the engine for lubrication of a valve train.

A pressure reducing valve connected between the main bearing gallery and the cam gallery acts as a flow restrictor that selectively limits oil flow to the cam gallery. The pressure reducing valve includes an orifice to limit oil flow into the cam gallery under low oil pressure conditions. During high oil pressure conditions, the flow restrictor partially closes outlet openings to maintain a constant oil pressure in the cam gallery.

The restriction of oil flow to the cam gallery created by the valve forms back pressure before the valve which increases oil pressure in the main feed. The increased oil pressure within the main feed is then available for operating the hydraulically actuated device. As a result, the oil pressure to the hydraulically actuated device and the main bearing gallery is increased while the rest of the oil system operates at a lower oil pressure. This allows cam phasing or cylinder deactivation at engine idle or other conditions when oil pump pressure would otherwise be too low to actuate the cam phaser or the switching lifters. The increased oil pressure supplied to the hydraulically actuated device allows the device to be operated at all engine speeds without a large increase in the size of the oil pump. The use of a smaller oil pump reduces parasitic losses for increased engine efficiency.

These and other features and advantages of the invention will be more fully understood from the following description of certain specific embodiments of the invention taken together with the accompanying drawings.

DESCRIPTION OF THE PREFERRED EMBODIMENT

Figure 1:
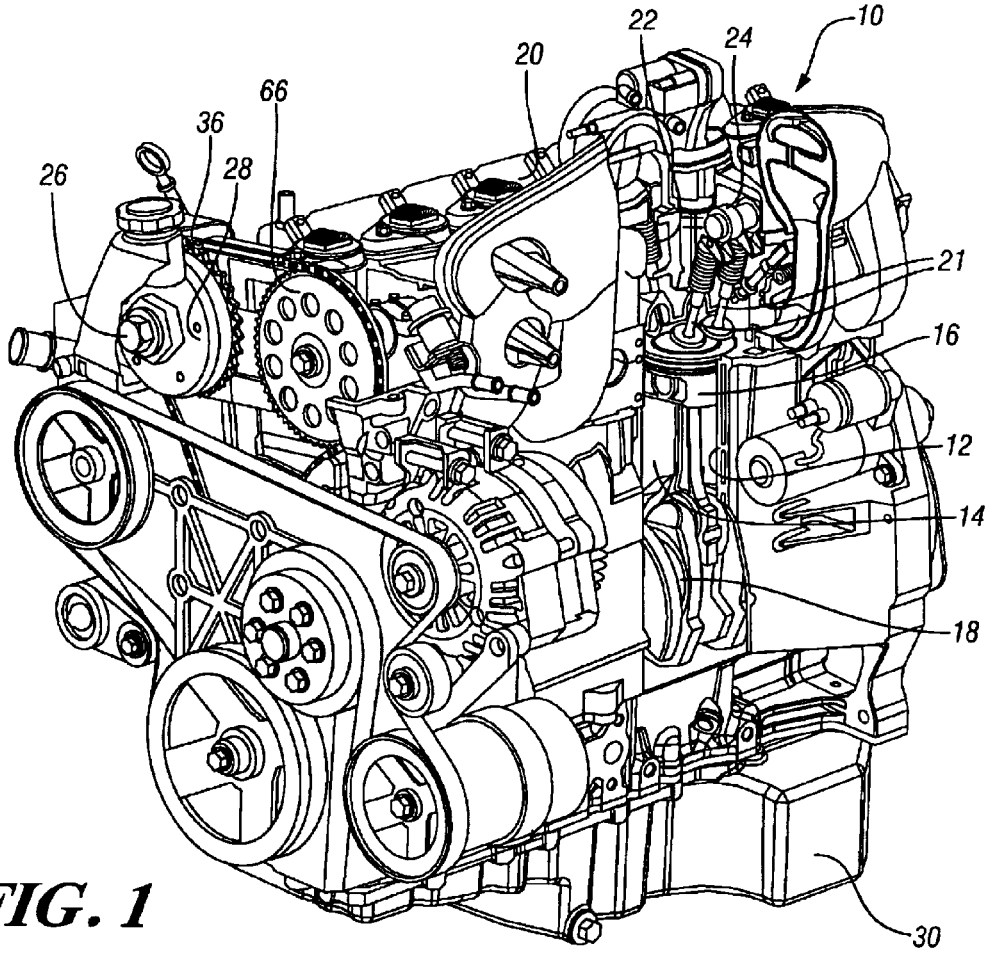
FIG. 1 is a pictorial view of an internal combustion engine including an oil system with a cam phaser according to the invention.

Referring now to FIG. 1 of the drawings in detail, numeral 10 generally indicates an internal combustion engine. The engine includes a cylinder block 12 having a bank of cylinders 14 containing pistons 16 connected with a crankshaft 18. A cylinder head 20 carries intake and exhaust valves 21, 22 actuated by camshafts 24, 26. A cam phaser 28 is mounted on the exhaust camshaft 26 to vary the exhaust valve timing. An oil pan 30 below the block forms an oil sump for the engine.

Figure 2:
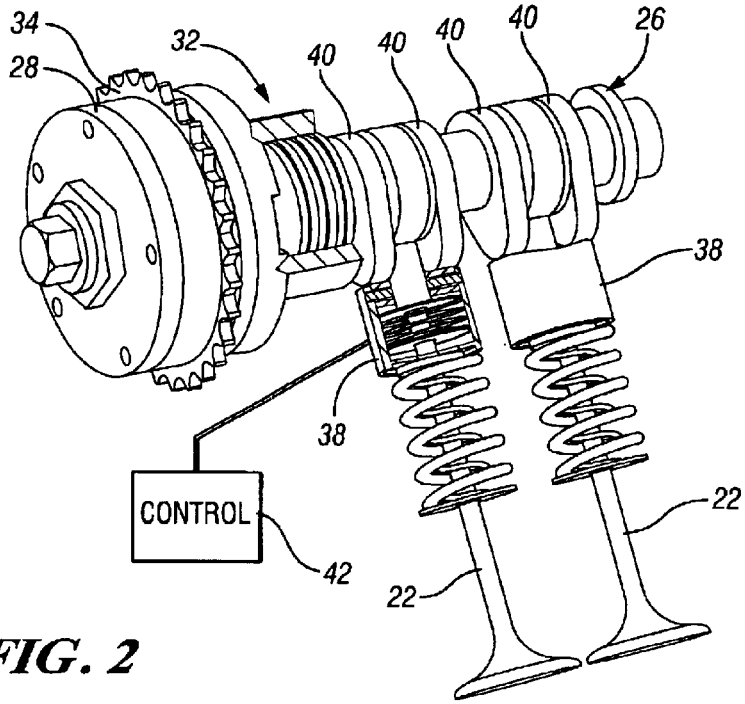
FIG. 2 is a pictorial view of a portion of a direct acting valve train with switching lifters having portions broken away to show interior features of the components.

FIG. 2 illustrates an exhaust portion of an engine valve train 32 for use in an overhead cam piston type engine. The valve train 32 includes exhaust camshaft 26 which is driven through a drive sprocket 34 connected by a chain 36 (FIG. 1) with the engine crankshaft 18. Cam phaser 28 is connected between the sprocket 34 and the camshaft 26 in order to vary the timing of the camshaft relative to the piston motion and other operating functions of the engine and relative to other camshafts of the engine.

The exhaust valves 22 are actuated through switching valve lifters 38 which are engaged by cams 40 of the camshaft 26. The switching valve lifters 38 react to oil pressure to deactivate or selectively change the amount of valve lift provided for the associated exhaust valves 22. A controller 42 receives oil pressure and distributes or cuts off the control pressure to the switching lifters 38 to actuate the valve train 32. The controller 42 may supply oil pressure to the switching lifters 38 to reduce valve lift or disable valve lift for cylinder deactivation.

Figure 3:
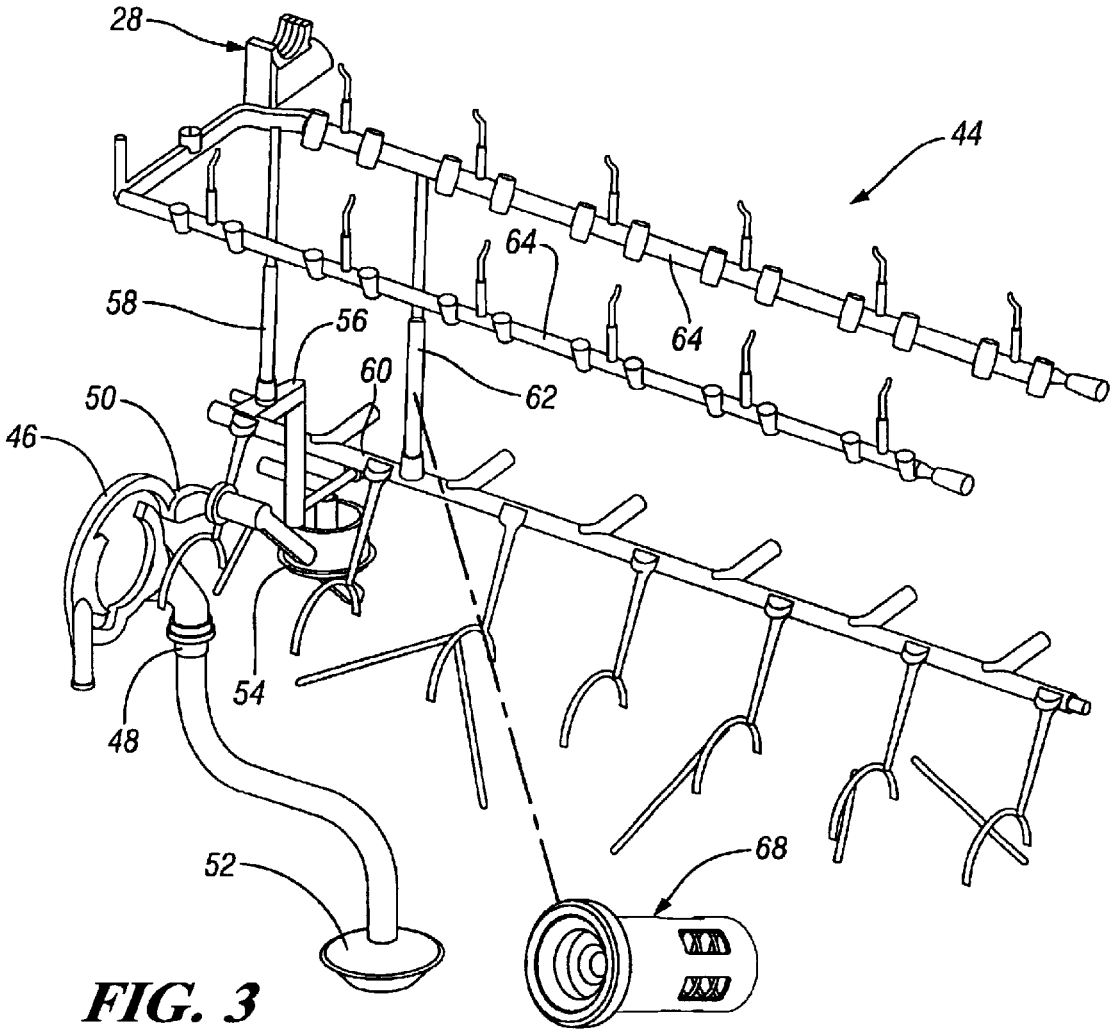
FIG. 3 is a pictorial view of an exemplary oil system for the engine of FIG. 1.

FIG. 3 illustrates the passages of an oil system 44 within the engine 10. The oil system includes an engine driven oil pump 46 having an inlet 48 and an outlet 50. An oil pickup 52 connected with the pump 46 extends into the sump of the oil pan 30. The pump 46 connects through an oil filter 54 with a main oil feed 56. The main oil feed 56 distributes oil to a cam phaser feed 58 and a main bearing gallery 60. The main bearing gallery 60 supplies oil to crankshaft main bearings and connecting rod bearings, not shown. The main bearing gallery 60 connects a cam gallery feed 62 which carries oil to a cam gallery 64 for lubricating camshaft bearings and valve gear 66 within the cylinder head 20 of the engine 10.

Figure 4:
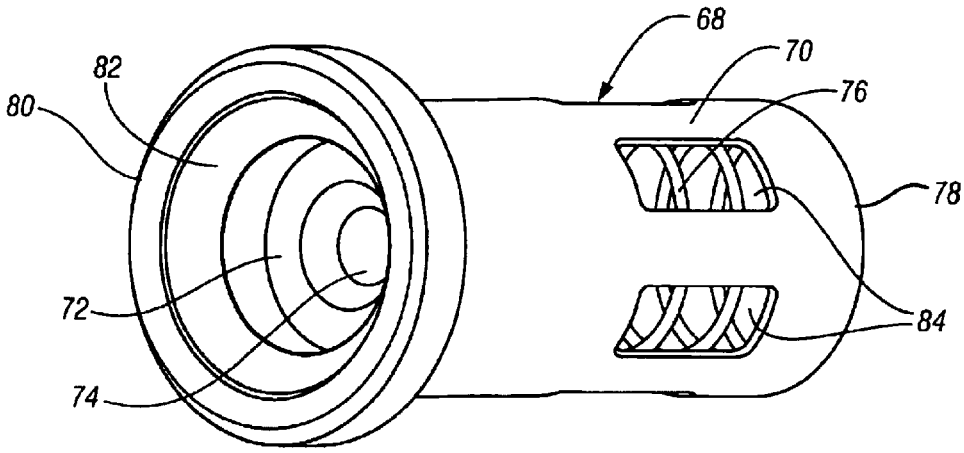
FIG. 4 is a pictorial view of a pressure reducing valve for the oil system.

In accordance with the invention, a pressure reducing valve 68, as shown in FIG. 4 is, connected between the main bearing gallery 60 and the cam gallery 64. The pressure reducing valve 68 has a tubular housing 70 surrounding a slidable flow control piston 72. The piston 72 internally defines an orifice 74. A biasing spring 76 between the piston 72 and an outlet end 78 of the housing 70 urges the piston 72 toward an inlet end 80 of the housing having a large inlet opening 82. A plurality of outlet openings 84 extend through a tubular wall of the housing 70 adjacent the outlet end 78.

During engine operation, the oil pump 46 draws oil from the oil pan 30 through the oil pickup 52. The oil is then pumped through the pump outlet 50 and oil filter 54 to the main oil feed 56. The oil in the main oil feed 56 is then directed to the main bearing gallery 60 and the cam phaser 28. Some of the oil in the main bearing gallery 60 flows to the cam gallery 64 through the pressure reducing valve 68.

Under low oil pressure conditions, the biasing spring 76 holds the flow control piston 72 against the inlet end 80 of the housing 70, opening the outlet openings 84 to allow oil to flow through the pressure reducing valve 68. Thus, oil flow from the ma in bearing gallery 60 passes through the piston orifice 74 into the outlet end 78 of the housing 70 and through the outlet openings 84 to the cam gallery 64.

As oil pressure increases at the inlet end 80 of the housing 70, the piston 72 begins to slide toward the outlet end 78 and compress the biasing spring 76. As the piston 72 moves toward the outlet end 78, the piston restricts access to the outlet openings 84 to maintain constant oil pressure to the cam gallery 64. As oil pressure on the inlet end 80 of the housing 70 is reduced, the biasing spring 76 pushes the piston 72 back toward the inlet end 80 to open the outlet openings 84 and maintain constant oil pressure to the cam gallery 64.

At lower engine speeds while oil pump output is minimal, only a small portion of the oil pumped though the oil system 44 flows through the orifice 74 of the pressure reducing valve 68. The remainder of the oil not flowing through the orifice 74 builds oil pressure on the inlet end 80 of the pressure reducing valve 68 which creates back pressure in the main bearing gallery 60 and in turn increases oil pressure to main oil feed 56 and the cam phaser 28. This allows the cam phaser 28 to actuate during idle and low rpm conditions, when oil pump pressure would otherwise be too low for cam phaser actuation.

As engine speed increases, the output from the oil pump 34 increases, causing the oil pressure in the system 32 to increase. As oil pressure increases at the inlet end 68, the piston 60 slides toward the outlet end 66 against the biasing spring 64. The movement of the piston 60 restricts flow through the pressure reducing valve 56 by closing the outlet openings 72. The restriction of oil to flow through the pressure reducing valve 56 maintains a lower oil pressure in the cam gallery than in the remainder of the system. The restriction of oil flow to the cam gallery 64 limits the system's oil flow requirements, thereby allowing the engine 10 to operate with a smaller more efficient oil pump.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A lubrication system for an internal combustion engine, the system comprising:

an oil pump driven by the engine and supplying pressurized oil through a main oil feed to a main bearing gallery, a cam gallery, and a hydraulically actuated device; and a pressure reducing valve connected between the pump and the cam gallery and operative to selectively limit oil flow to the cam gallery and thereby raise oil pressure supplied to the main bearing gallery and hydraulically actuated device to a desired operating level greater than the oil pressure supplied to the cam gallery.

2. A system as in claim 1 wherein the hydraulically actuated device is a cam phaser.

3. A system as in claim 1 wherein the hydraulically actuated device is a series of switching lifters.

4. A system as in claim 1 wherein the hydraulically actuated device is a stepping valve train.

5. A system as in claim 2 wherein the pressure reducing valve includes an open orifice limiting oil flow to the cam gallery to maintain a desired minimum oil pressure to the main bearing gallery and cam phaser at lower engine speeds.

6. A system as in claim 2 wherein the pressure reducing valve maintains adequate cam phaser oil pressure during engine operation.

7. A system as in claim 2 wherein the pressure reducing valve increases oil pressure to the cam phaser as engine speed increases.

8. A system as in claim 1 wherein the cam gallery receives oil from the main bearing gallery.

9. A system as in claim 1 including an oil pickup connected with an inlet of the pump to draw in oil from an engine oil pan.

10. A system as in claim 1 including an oil filter connected between the outlet of the oil pump and the main oil feed.

11. A system as in claim 1 wherein the pressure reducing valve maintains a constant oil pressure in the cam gallery during engine operation.

* * * * *